US008602064B2

(12) United States Patent
Yoneda et al.

(10) Patent No.: US 8,602,064 B2
(45) Date of Patent: Dec. 10, 2013

(54) FLUID PASSAGE CLOSURE SYSTEM IN COMPRESSOR

(75) Inventors: Masato Yoneda, Aichi-ken (JP); Hiroyuki Nagai, Aichi-ken (JP); Atsushi Shimizu, Aichi-ken (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 128 days.

(21) Appl. No.: 13/366,643

(22) Filed: Feb. 6, 2012

(65) Prior Publication Data

US 2012/0211102 A1 Aug. 23, 2012

(30) Foreign Application Priority Data

Feb. 17, 2011 (JP) ..... 2011-032369

(51) Int. Cl.
*F04B 39/12* (2006.01)
*F04C 29/00* (2006.01)

(52) U.S. Cl.
USPC ..... 138/89; 137/800; 220/328

(58) Field of Classification Search
USPC ..... 137/800; 138/89; 220/328
See application file for complete search history.

(56) References Cited

U.S. PATENT DOCUMENTS 757,376 A * 4/1904 Whitaker ..... 138/89
4,979,885 A * 12/1990 Yasuda et al. ..... 137/800
5,496,141 A * 3/1996 Popsys ..... 138/89
5,868,558 A * 2/1999 Parker ..... 220/327
5,988,223 A * 11/1999 Kanzaki et al. ..... 138/89
6,053,350 A * 4/2000 Suitou et al. ..... 220/327
6,082,410 A * 7/2000 Pohar ..... 138/89
6,290,092 B1 * 9/2001 Cote et al. ..... 138/89
6,508,520 B2 * 1/2003 Sampson et al. ..... 138/89
6,802,698 B2 * 10/2004 Tsukamoto ..... 417/234
7,588,426 B2 * 9/2009 De Palma et al. ..... 418/1
2013/0075405 A1 * 3/2013 Saito et al. ..... 220/328

FOREIGN PATENT DOCUMENTS

JP 58-76862 5/1983
JP 07-158564 6/1995
JP 09-250479 9/1997
JP 11-82858 3/1999
JP 2006-022717 1/2006

* cited by examiner

*Primary Examiner* — John Rivell
(74) *Attorney, Agent, or Firm* — Greenblum & Bernstein P.L.C.

(57) ABSTRACT

A fluid passage closure system in a compressor includes a fluid passage, a seal cap unit and a flow space. The fluid passage formed in the housing of the compressor includes a large-diameter and the small-diameter passages, a step formed between the large-diameter and the small-diameter passages and a flat portion formed in the step. The large-diameter passage is formed on the opening side of the fluid passage and connected to the small-diameter passage. The seal cap unit closing the fluid passage includes a flat sealing surface and a press-contact surface. The flat sealing surface is in contact with the flat portion to close the fluid passage. The press-contact surface is formed to be pressed against the peripheral wall surface so that the seal cap unit is kept in the fluid passage. The flow space is formed between the press-contact surface and the peripheral wall surface.

5 Claims, 7 Drawing Sheets

FLUID PASSAGE CLOSURE SYSTEM IN COMPRESSOR

BACKGROUND OF THE INVENTION

The present invention relates to a fluid passage closure system in a compressor for a vehicle air conditioner or a household air conditioner, which hermetically closes the compressor by using a seal cap disposed in the fluid passage of the compressor.

In general, compressors for vehicle air conditioners are assembled as a part of the compressor in a compressor manufacturing plant and the assembled compressors are delivered to a vehicle assembly plant, where the compressors are assembled into vehicle air conditioners. In the compressor manufacturing plant, the compressor is filled with a predetermined amount of lubricating oil before shipment for preventing corrosion and providing sufficient lubrication for the sliding parts of the compressor. Conventionally, a seal cap is located in a fluid passage in the compressor, such as a suction port and a discharge port, to hermetically close the compressor for preventing the leakage of lubricating oil or the ingress of dust or moisture into the compressor during the shipment or storage of the compressors.

Inspection for gas leakage from the compressors is conducted for leakage from the compressors, specifically from the joint through which the compressor is mounted on the vehicle or from any other parts of the compressor. The inspection for gas leakage is conducted by firstly inserting an injection needle through a cylindrical seal cap attached in the fluid passage of the compressor and then injecting gas into the compressor through the injection needle. Then, the compressor is set in a vacuum case and inspected whether or not gas leaks out from the compressor.

Conventionally, there has been two ways of sealing a fluid passage of a compressor by using the cylindrical seal cap, one is sealing by using the cylindrical peripheral surface of the cylinder of the seal cap (hereinafter referred to as "cylinder sealing") and the other is sealing by using the flat surface of the cylindrical seal cap (hereinafter referred to as "flat sealing").

Sealing by using cylindrical peripheral surface or cylinder sealing is disclosed, for example, in Japanese Patent application Publication No. 11-82858. The fluid passage closure system disclosed in the Publication No. 11-82858 has a mounting member made of a resin material and a closure member made of an elastic material and fixed to the mounting member. In this fluid passage closure system, the cylindrical closure portion of the closure member is press-fitted in the suction port of the compressor and the mounting member is fixed on the housing of the compressor by a stud bolt that is screwed in the housing, extending through a hole in the mounting member and tightened by a nut. Thus, the cylindrical closure portion of the closure member is press-fitted in the suction port of the compressor, so that the peripheral surface of the cylindrical closure portion of the closure member is closely in contact with the inner wall surface of the suction port thereby to hermetically close the suction port.

A plug for temporarily closing the input-output port by using flat surface or flat sealing is disclosed in the Japanese Unexamined Utility Model Application Publication No. 58-76862. The plug is made of a synthetic resin material having elasticity and a ring-shaped flange closely in contact with the end surface of the input-output port and a cylindrical portion inserted in the input-output port and engaged with the inner surface of the input-output port. The cylindrical portion of the plug has a plurality of slits cut and extending in the axial direction of the plug. The input-output port is closed by the ring-shaped flange, and the slits formed in the cylindrical portion facilitates attachment and detachment of the plug.

Although nothing is mentioned in the Publication No. 11-82858 about the method of inspection for a closure state of the compressor, gas may be injected into the compressor by using an gas injection needle inserted through the closure member made of an elastic material. The hole formed by removing the gas injection needle from the closure member is closed by the elasticity of the closure portion of the closure member used for hermetically closing the fluid passage. Thus, the closure state of the compressor is not impaired by the inspection and, therefore, the inspection for gas leakage from the compressor may be conducted by using the fluid passage closure system as it is.

According to the plug for temporarily closing the fluid passage by flat sealing disclosed in the Publication No. 58-76862, an gas injection needle may be inserted through the ring-shaped top surface of the projection at the center thereof for gas injection into the input-output port for inspection for gas leakage from the compressor. However, the hole formed when the gas injection needle is removed is not closed completely by the elasticity of the plug. Therefore, in an apparatus such as compressor requiring an inspection for the closure state, the plug for temporarily closing the input-output port by flat sealing cannot be used for the inspection for gas leakage. Conventionally, gas is injected into the compressor by using special equipment for gas injection. Then, a plug for temporarily closing a port by flat sealing is set in the fluid passage, and the inspection for gas leakage is conducted. Thus, the operation for the inspection is troublesome and time consuming.

The present invention is directed to providing a fluid passage closure system in a compressor according to which inspection for a closure state of the compressor may be conducted by using a seal cap that closes a fluid passage by flat sealing.

SUMMARY OF THE INVENTION

In accordance with the present invention, a fluid passage closure system in a compressor having a housing includes a fluid passage, a seal cap unit and a flow space. The fluid passage is formed in the housing so as to be opened to the outside of the housing and communicable with the inside of the compressor. The fluid passage includes a large-diameter and the small-diameter passages, a step and a flat portion. The large-diameter passage is formed on the opening side of the fluid passage and has a peripheral wall surface. The small-diameter passage is connected to the large-diameter passage. The step is formed between the large-diameter and the small-diameter passages. The flat portion is formed in the step. The seal cap unit closes the fluid passage and includes a flat sealing surface and a press-contact surface. The flat sealing surface is in contact with the flat portion which is formed to extend in a direction perpendicular to a direction in which the seal cap unit is inserted thereby to close the fluid passage. The press-contact surface is formed to be pressed against the peripheral wall surface of the large-diameter passage so that the seal cap unit is kept in the fluid passage. The flow space is formed between the press-contact surface of the seal cap unit and the peripheral wall surface of the large-diameter passage.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

The following will describe a fluid passage closure system in a compressor for a vehicle air conditioner according to a first preferred embodiment of the present invention with reference to FIGS. 1 through 6. The following description will deal with an example of the fluid passage closure system as applied for closing a suction port of the compressor. It is noted that hermetically closing of the compressor is accomplished by closing both of the suction port and the discharge port of the compressor. For the sake of description herein, the top and the bottom sides and the left and the right sides of FIG. 1 correspond to the top and the bottom sides and the left and the right sides of the compressor, respectively.

Figure 1:
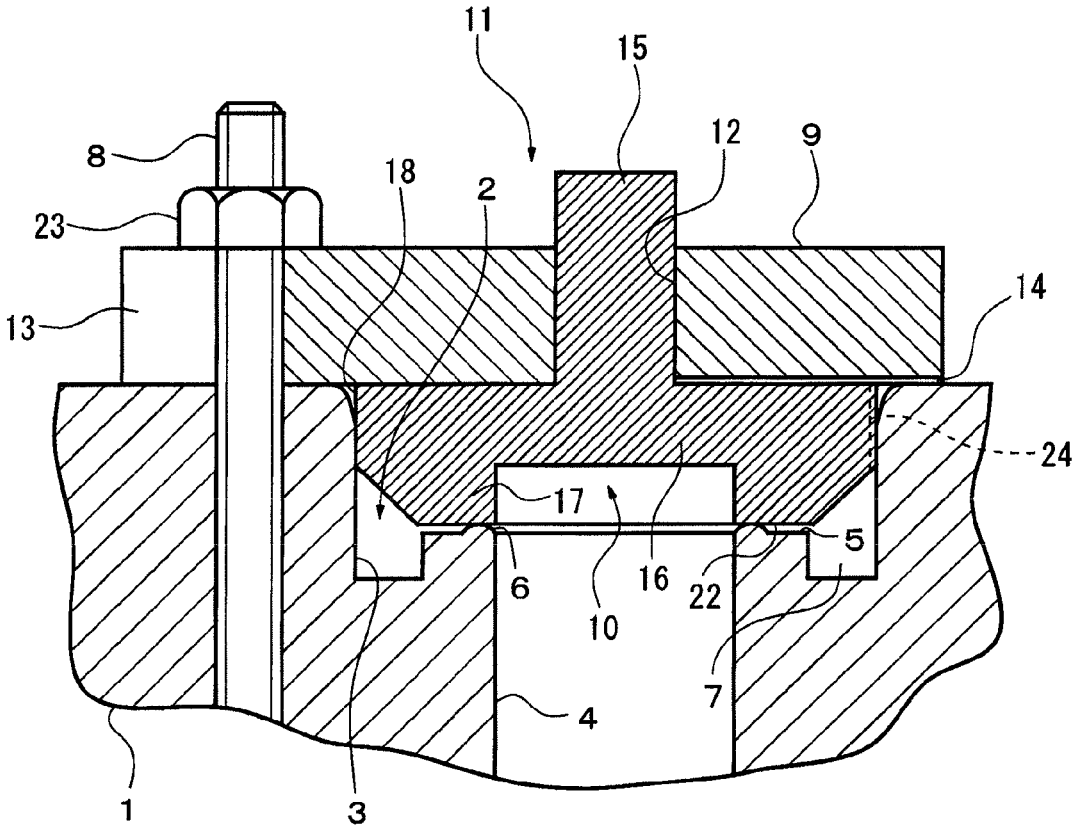
FIG. 1 is a sectional view of a fluid passage closure system in a compressor according to a first preferred embodiment of the present invention, showing a seal cap unit mounted in the housing of a compressor.
Figure 2:
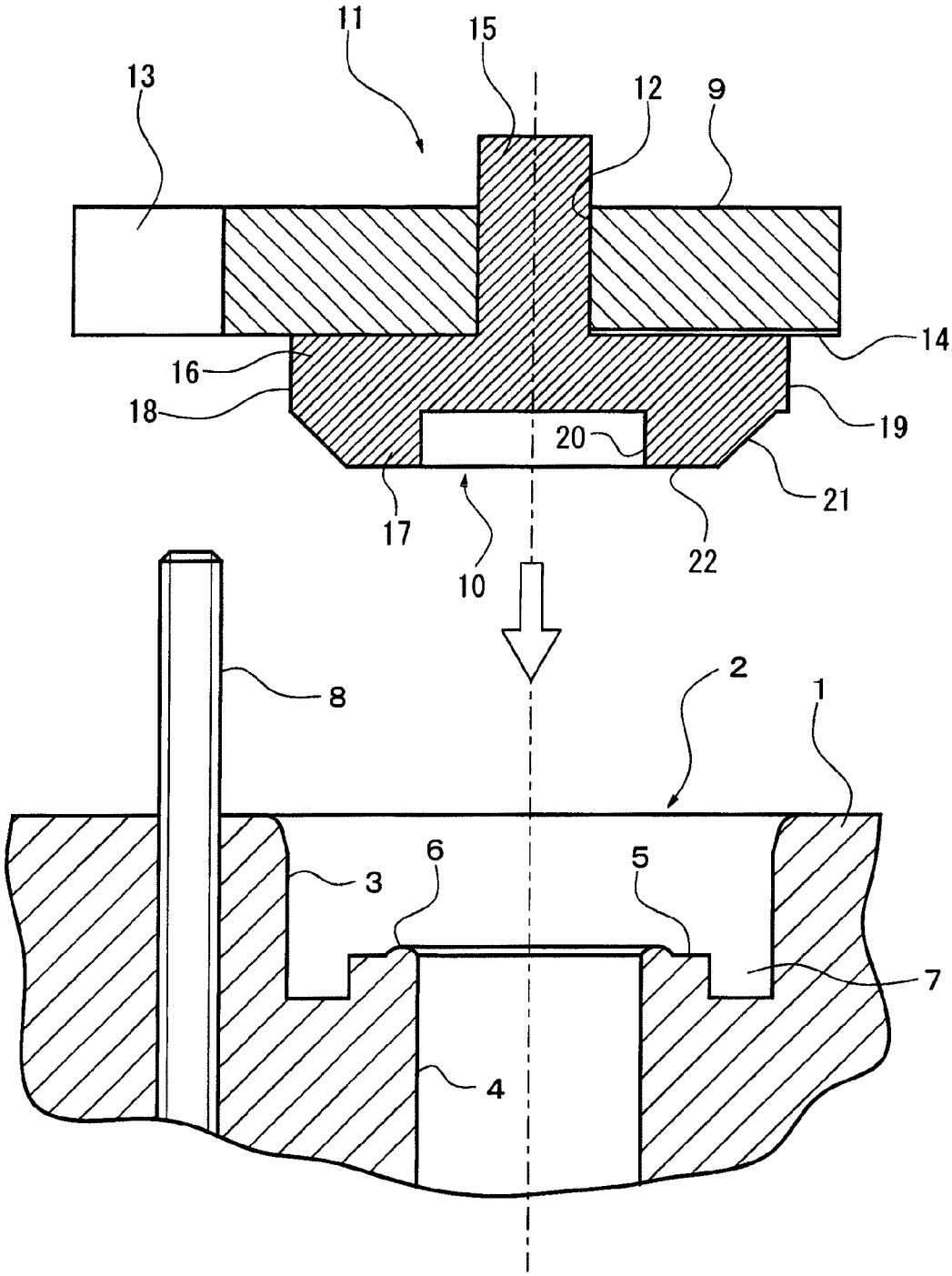
FIG. 2 is a sectional view of the fluid passage closure system of FIG. 1, showing the seal cap unit separated from the housing of the compressor.

Referring to FIGS. 1 and 2, numeral 1 designates a housing of a compressor having formed therein a fluid passage 2 that is opened to the outside of the housing 1 for connection with a tube for a refrigerant circuit and communicable with the inside of the compressor. The fluid passage 2 has a circular section and includes a large-diameter passage 3 formed on the opening side of the fluid passage 2 and a small-diameter passage 4 formed on the inner side of the fluid passage 2 or inward of the large-diameter passage 3 in the compressor. As shown in FIG. 1, part of the housing 1 at the periphery of the small-diameter passage 4 projects outward so as to form a step between the large-diameter passage 3 and the small-diameter passage 4 so as to surround the small-diameter passage 4 for sealing. The step, a cylindrical projection or a connecting portion connecting two peripheral wall surfaces of the large-diameter and the small-diameter passages 3, 4 has a flat portion 5 formed to extend in the direction perpendicular to the direction in which a seal cap unit 11 described later is inserted. An annular projection 6 is formed in the flat portion 5 at the top surface thereof so as to be in contact with a flat sealing surface 22 described later. The large-diameter passage 3 has an annular groove 7 formed to extend around the annular projection 6 and toward the bottom of the compressor to a level lower than the top of the flat portion 5. The flat portion 5 is positioned between the annular groove 7 and the small-diameter passage 4, as shown in FIG. 1. Alternatively, the annular groove 7 of the large-diameter passage 3 may be formed to extend toward the bottom of the compressor to a level equal to the top of the flat portion 5 thereby not to have a groove shape, but to have a flat shape and be indistinguishable from the flat portion 5.

A stud bolt 8 is inserted in the housing 1 at a position adjacent to the fluid passage 2, as shown in FIG. 1. The stud bolt 8 has a nut 23 and is used for fixing to the housing 1 the tube for the refrigerant circuit arranged to the fluid passage 2 during assembling the vehicle air conditioner to the compressor.

The seal cap unit 11 includes a resin cap 9 and an elastic cap 10 and is used for closing the fluid passage 2 of the housing 1. The resin cap 9 is made of a resin material, such as polypropylene, and the elastic cap 10 is made of an elastic material of natural rubber or synthetic rubber. Alternatively, the elastic cap 10 may be made of an elastic material having elasticity which is substantially the same level as that of the natural rubber or synthetic rubber.

Figure 3:
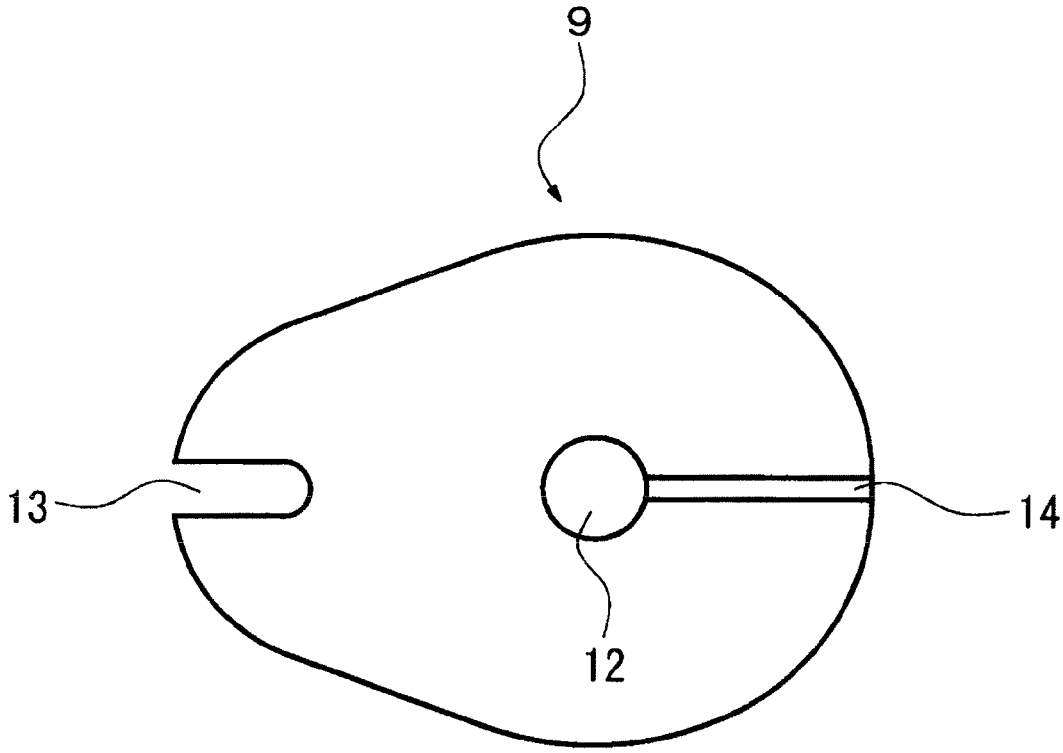
FIG. 3 is a bottom view of a resin cap of the seal cap unit of FIG. 1.

As shown in FIG. 3, the resin cap 9 is formed such that the right half thereof is large than the left half so as to completely cover the opening of the large-diameter passage 3 of the fluid passage 2 and also to be contactable with the outer surface of the housing 1. The resin cap 9 has formed therethrough a hole 12 at the center, an elongated hole 13 is formed through the resin cap 9 at the left end thereof and an elongated groove 14 is formed in the bottom of the resin cap 9 and opened outward at the right end.

Figure 4:
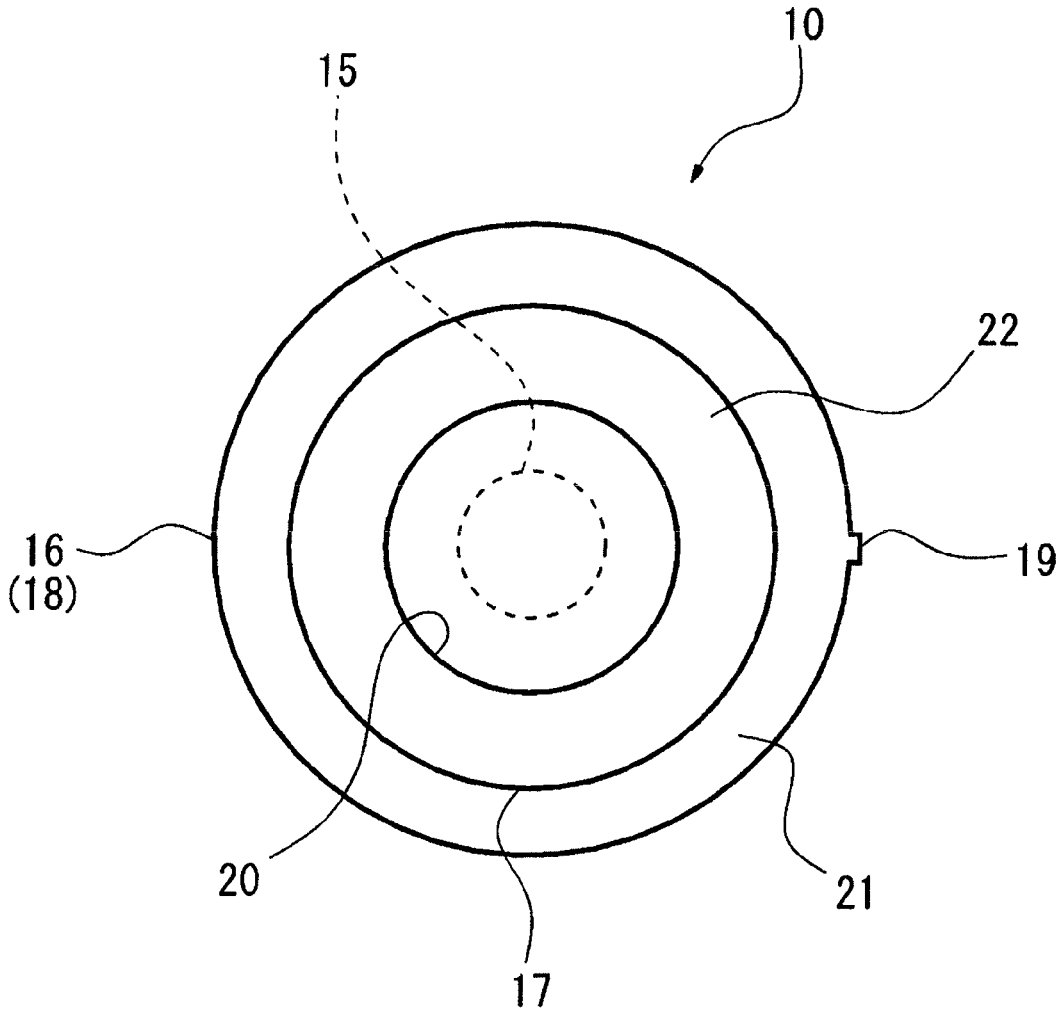
FIG. 4 is a bottom view of an elastic cap of the seal cap unit of FIG. 1.

The elastic cap 10 is formed into a generally circular shape, as shown in FIG. 4. Specifically, the elastic cap 10 includes a shaft portion 15, a disk portion 16 and a ring-shaped portion 17, as shown FIGS. 1 and 2. The shaft portion 15 is formed to have a cylindrical shape extending upward from the center of disk portion 16, the disk portion 16 is formed to have a larger diameter than the shaft portion 15, and the ring-shaped portion 17 is formed to have a ring shape tapered away from the disk portion 16. The shaft portion 15 is formed to have an outer diameter that is slightly larger than the inner diameter of the hole 12 of the resin cap 9 and an axial length that is greater than the thickness of the resin cap 9.

The disk portion 16 is formed to have an outer diameter that is larger than the inner diameter of the large-diameter passage 3 of the fluid passage 2 and the outer peripheral surface of the disk portion 16 is formed as a press-contact surface 18 to be pressed against the peripheral wall surface of the large-diameter passage 3 corresponding to the surface of the housing 1 so that the seal cap unit 11 is kept in the fluid passage 2, as shown in FIG. 1. The press-contact surface 18 is formed with a single projection 19 extending vertically over the distance corresponding to the thickness of the disk portion 16. Alternatively, a plurality of the projections such as 19 may be formed on the peripheral surface of the disk portion 16. In this case, it is preferable that as many grooves such as 14 as the projections should be formed in the bottom of the resin cap 9. The ring-shaped portion 17 of the elastic cap 10 has an inner peripheral surface 20 and the diameter of a circle formed by the inner peripheral surface 20 is substantially the same as or slightly smaller than the inner diameter of the small-diameter passage 4 of the fluid passage 2. The ring-shaped portion 17 further has an outer peripheral surface 21 which is tapered downward. The outer peripheral surface 21 of the ring-shaped portion 17 is directly connected to the press-contact surface 18. The bottom surface of the ring-shaped portion 17 forms a flat sealing surface 22 which is closely in contact with the flat portion 5 thereby to close the small-diameter passage 4 of the fluid passage 2 by flat sealing. The flat sealing surface 22 has an annular shape with a width that is large enough to cover the flat portion 5 of the fluid passage 2. Alternatively, the ring-shaped portion 17 may be modified to have a disk shape formed integrally with the disk portion 16 thereby to form the flat sealing surface 22.

The resin cap 9 and the elastic cap 10 are formed separately, and the shaft portion 15 of the elastic cap 10 is press-fitted in the hole 12 of the resin cap 9, so that the resin cap 9 is integrally formed with the elastic cap 10, and the resin cap 9 and the elastic cap 10 cooperate to integrally form the seal cap unit 11.

When a compressor is assembled in a compressor manufacturing plant, the seal cap unit 11 is mounted in the fluid passage 2 of the manufactured compressor. Mounting of the seal cap unit 11 is accomplished by setting the elastic cap 10 in the large-diameter passage 3 of the fluid passage 2 with the stud bolt 8 passed through the elongated hole 13 of the resin cap 9 and then press-fitting the disk portion 16 into the large-diameter passage 3 such that the flat sealing surface 22 of the ring-shaped portion 17 is pressed tightly against the annular projection 6 formed on the flat portion 5 of the step. Thus, pressing the flat sealing surface 22 against the annular projection 6 the flat portion 5 of the step seals the flat portion 5 which extends perpendicular to the fluid passage 2, thereby hermetically closing the small-diameter passage 4 and hence the fluid passage 2. Part of the bottom surface of the resin cap 9 is in contact with the outer surface of the housing 1, and the seal cap unit 11 is fixed to the outer surface of the housing 1 by tightening the nut 23 on the stud bolt 8, as shown in FIG. 1.

Figure 5:
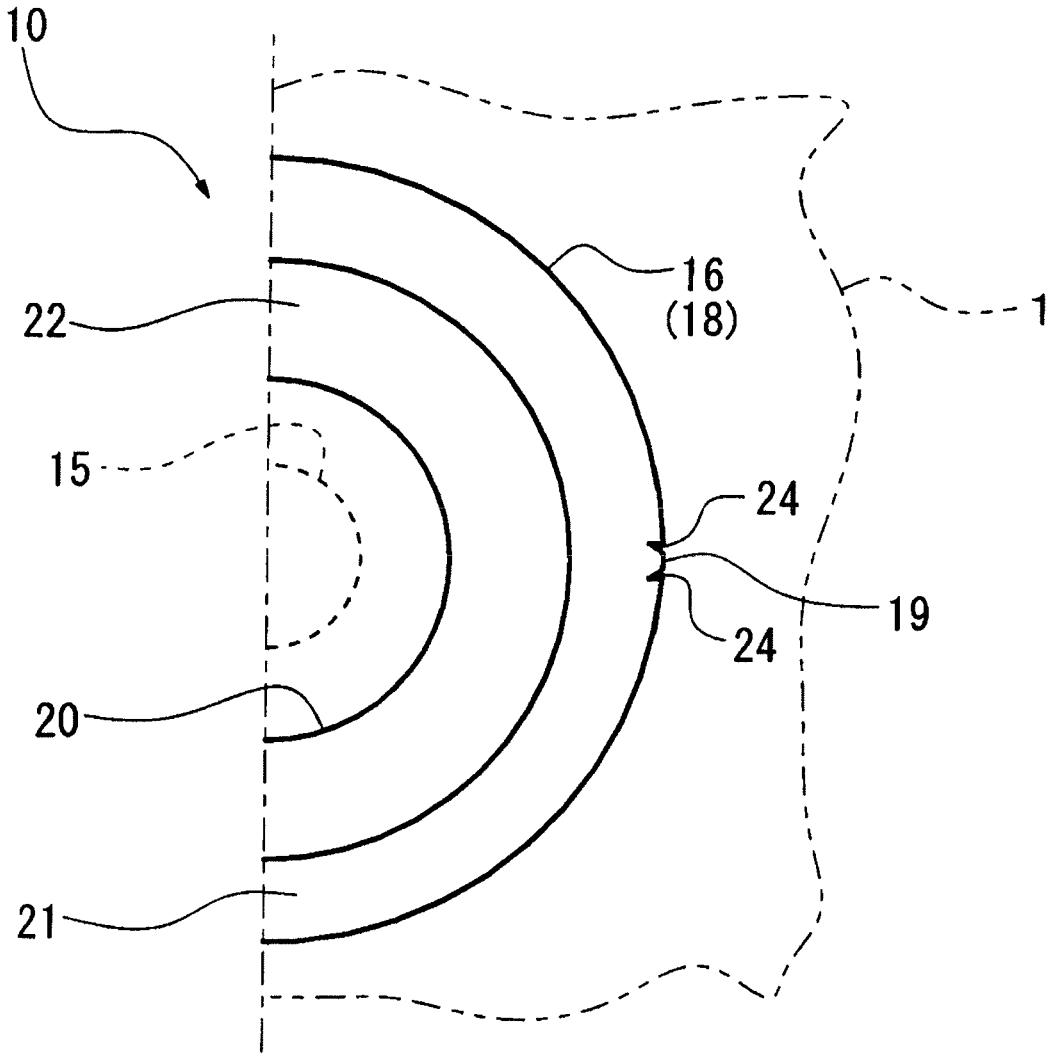
FIG. 5 is a fragmentary bottom view of the elastic cap of FIG. 4 as mounted.

When the disk portion 16 is press-fitted in the large-diameter passage 3, the projection 19 on the press-contact surface 18 is deformed such that the projection 19 is press-fitted in the disk portion 16. The press-contact surface 18 receives strong pressure against the peripheral wall surface of the large-diameter passage 3 or the surface of the housing 1 due to the elasticity of the disk portion 16. Referring to FIG. 5, a flow space 24 is formed by the deformation of the projection 19 between the press-contact surface 18 and the deformed projection 19, through which gas is allowed to pass. In forming the seal cap unit 11, forming the projection 19 on the press-contact surface 18 is easier than forming a recess in the press-contact surface 18, and the flow space 24 may be formed easily by deforming the projection 19 by using press-contact force between the press-contact surface 18 and the peripheral wall surface of the fluid passage 2. When the seal cap unit 11 is inserted in the fluid passage 2, the flat sealing surface 22 of the elastic cap 10 hermetically closes the small-diameter passage 4. However, the fluid passage 2 on the opening side of the flat sealing surface 22 is communicable with the outside of the housing 1 through the flow space 24 and the groove 14 formed in the bottom of the resin cap 9. Therefore, gas leaking through any space between the flat sealing surface 22 and the annular projection 6 may be guided outside the housing 1 through the flow space 24 and the groove 14.

Figure 6:
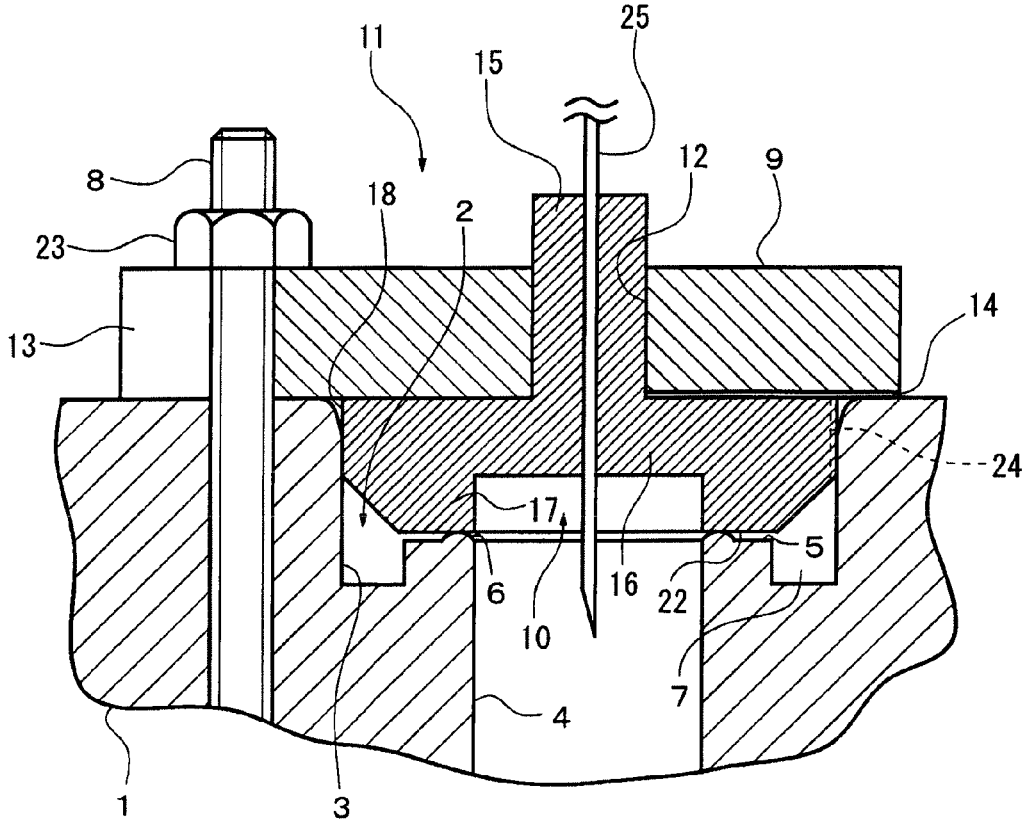
FIG. 6 is a sectional view of the fluid passage closure system of FIG. 1, showing the seal cap unit when filling the compressor with gas.

When the seal cap unit 11 is inserted in the fluid passage 2, the compressor is filled with gas for inspection for any gas leakage from the compressor. As shown in FIG. 6, an gas injection needle 25 is inserted through the center of the shaft portion 15, and gas is injected into the compressor through the gas injection needle 25 and the small-diameter passage 4. When the gas injection is completed, the gas injection needle 25 is removed from the elastic cap 10 so that a hole is formed in the elastic cap 10.

The hole formed in the elastic cap 10 when the gas injection needle 25 is removed is decreased in size due to the reaction force of the press-fitting force of the press-contact surface 18 of the disk portion 16, and then is disappeared from the disk portion 16 of the elastic cap 10. In the shaft portion 15, the hole formed by the gas injection needle 25 also disappears due to the reaction force of the press-fitting force of the shaft portion 15 in the hole 12. Thus, the closure state of the fluid passage 2 by the seal cap unit 11 after injecting of gas into the compressor is maintained as the state before inserting the gas injection needle 25 through the seal cap unit 11. Then, the compressor is placed in a vacuum chamber for inspection for any gas leakage from the compressor. If the sealing of the flat sealing surface 22 is not sufficient, gas in the compressor leaks through a space between the flat sealing surface 22 and the annular projection 6 of the flat portion 5 and flows into the annular groove 7. Then, the gas flows through the flow space 24 and the groove 14 and then outside the housing 1. Thus, the gas leakage from the compressor may be detected. When the sealing of the flat sealing surface 22 is not enough to prevent gas leakage, it is determined that there is a problem the machined flat portion 5.

The first preferred embodiment of the present invention offers the following advantageous effects.

(1) The seal cap unit 11 having the flat sealing surface 22 is configured such that the press-contact surface 18 of the elastic cap 10 is press-fitted in the fluid passage 2 by the elasticity of the press-contact surface 18 of the elastic cap 10, so that any hole formed in the elastic cap 10 by the gas injection needle 25 disappears so as to maintain the closure state of the fluid passage 2. Thus, in the fluid passage closure system in which the fluid passage 2 is closed by flat sealing, inspection for gas leakage from the compressor may be conducted by using the seal cap unit 11 inserted in the fluid passage 2.

(2) The flow space 24 for allowing gas to pass therethrough may be formed easily by the projection 19 formed on the press-contact surface 18 and the press-contact force of the press-contact surface 18.

(3) The flow space 24 formed in the press-contact surface 18 allows the fluid passage 2 on the opening side of the flat sealing surface 22 to be communicable with the outside of the housing 1, and the closure state of the fluid passage 2 or the sealing state of the flat sealing surface 22 may be detected reliably.

(4) Forming of the projection 19 on the press-contact surface 18 may be performed more easily than forming a recess in the press-contact surface 18, so that the manufacturing of the elastic cap 10 is facilitated.

(5) The elastic cap 10 of the seal cap unit 11 closes the fluid passage 2 and the seal cap unit 11 is fixed to the housing 1 of the compressor by the resin cap 9 of the seal cap unit 11 through the stud bolt 8 and the nut 23. Thus, tight closure state of the fluid passage 2 by the seal cap unit 11 is maintained securely.

Figure 7:
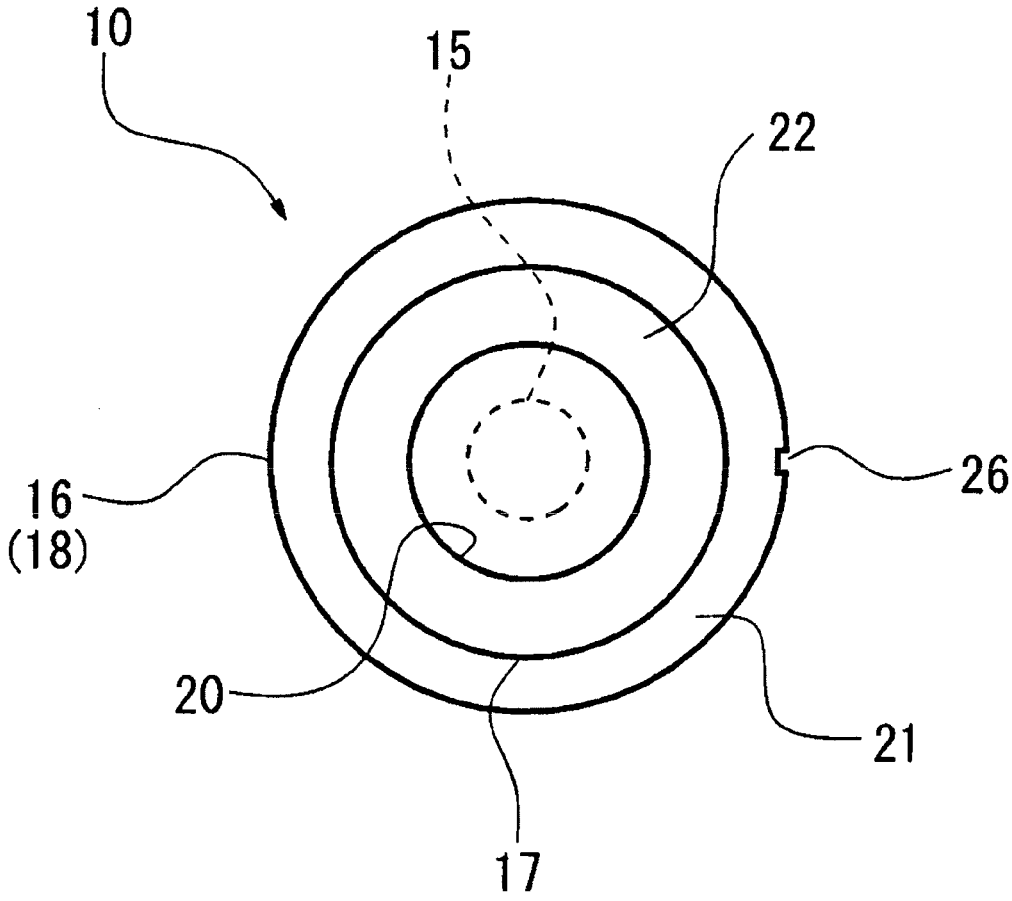
FIG. 7 is a view of a fluid passage closure system in a compressor according to a second preferred embodiment of the present invention, showing in bottom view the elastic cap of the seal cap unit.

The following will describe a second preferred embodiment of the present invention with reference to FIG. 7. The same reference numerals denote the components that are similar to the counterparts of the first preferred embodiment and the description thereof will be omitted. According to the second preferred embodiment of the present invention, a recess is formed in the press-contact surface 18 of the disk portion 16 of the elastic cap 10 instead of the projection 19 of the first preferred embodiment. The rest of the structure is substantially the same as that of the first preferred embodiment. When the disk portion 16 is press-fitted in the large-diameter passage 3 of the fluid passage 2, a flow space 26 is formed between the disk portion 16 and the peripheral wall surface of the large-diameter passage 3. The fluid passage 2 on the opening side of the flat sealing surface 22 is communicable with the outside of the housing 1 through the flow space 26 formed by the recess and the groove 14 formed in the bottom of the resin cap 9. Alternatively, a plurality of recesses such as 26 may be formed in the press-contact surface 18 as in the case of the first preferred embodiment of the present invention. According to the second preferred embodiment of the present invention, the same advantageous effects as the first preferred embodiment may be obtained.

The present invention is not limited to the first and second preferred embodiments described above, but it may be variously modified within the scope of the invention, as exemplified below.

According to the first preferred embodiment of the present invention, the groove 14 is formed in the bottom surface of the resin cap 9. Alternatively, the thicknesses of the resin cap 9 and the elastic cap 10 may be set in accordance with the axial length of the large-diameter passage 3 such that a slight space may be formed between the bottom surface of the resin cap 9 and the surface of the housing 1 with the flat sealing surface 22 set closely in contact with the annular projection 6. By so doing, the groove 14 in the bottom surface of the resin cap 9 may be dispensed with.

According to the first preferred embodiment, the annular projection 6 is formed on the flat portion 5 of the step. However, the annular projection 6 need not necessarily be formed for sealing. Alternatively, the annular projection 6 is dispensed with, and it may be so arranged that the flat sealing surface 22 is directly in contact with the flat portion 5 of the step.

According to the first preferred embodiment, the flow space 24 is formed by the deformation of the projection 19. Alternatively, the flow space 24 may be formed by a projection or a recess which is formed on or in the peripheral wall surface of the fluid passage 2.

According to the first preferred embodiment, the shaft portion 15 of the elastic cap 10 is press-fitted in the hole 12 of the resin cap 9. Alternatively, the shaft portion 15 of the elastic cap 10 may be loosely inserted in the hole 12 of the resin cap 9. In this case, the elastic cap 10 may be fixed to the resin cap 9 by using any suitable adhesive or a screw.

According to the first preferred embodiment, the resin cap 9 is fixed to the housing 1 by using the stud bolt 8 and the nut 23. Alternatively, the resin cap 9 may be fixed to the housing 1 by press-fitting the elastic cap 10 in the fluid passage 2 or a hole formed in the tube for refrigerant circuit (not shown).

According to the first preferred embodiment, the seal cap unit 11 includes the resin cap 9 and the elastic cap 10. Alternatively, the seal cap unit 11 may be formed only by a single part made of an elastic material, such as the elastic cap 10.

What is claimed is:

1. A fluid passage closure system in a compressor having a housing comprising:

a fluid passage formed in the housing so as to be opened to the outside of the housing and communicable with the inside of the compressor, the fluid passage includes:

a large-diameter passage formed on the opening side of the fluid passage, the large-diameter passage has a peripheral wall surface;

a small-diameter passage connected to the large-diameter passage;

a step formed between the large-diameter passage and the small-diameter passage; and a flat portion formed in the step, a seal cap unit closing the fluid passage, the seal cap unit includes:

a flat sealing surface being in contact with the flat portion, the flat portion is formed to extend in a direction perpendicular to a direction in which the seal cap unit is inserted to close the fluid passage; and a press-contact surface formed to be pressed against the peripheral wall surface of the large-diameter passage so that the seal cap unit is kept in the fluid passage; and a flow space formed between the press-contact surface of the seal cap unit and the peripheral wall surface of the large-diameter passage.

2. The fluid passage closure system according to claim 1, wherein the seal cap unit includes an elastic cap and a resin cap that is integrally formed with the elastic cap, and the elastic cap has the flat sealing surface and the press-contact surface.

3. The fluid passage closure system according to claim 2, wherein the resin cap is formed to cover an opening of the large-diameter passage and be contactable with an outer surface of the housing, a groove is formed in the bottom of the resin cap, and the flow space is communicable with the outside of the housing through the groove.

4. The fluid passage closure system according to claim 1, wherein the press-contact surface is formed with a projection, and the flow space is formed by the deformation of the projection by press-fitting the press-contact surface in the fluid passage.

5. The fluid passage closure system according to claim 1, wherein the flow space is formed by forming a recess in the press-contact surface.

* * * * *